United States Patent [19]

Hilfiker et al.

[11] 4,329,089

[45] May 11, 1982

[54] METHOD AND APPARATUS FOR RETAINING EARTHEN FORMATIONS THROUGH MEANS OF WIRE STRUCTURES

[75] Inventors: William K. Hilfiker; Harold O. Hilfiker; William B. Hilfiker, all of Eureka, Calif.

[73] Assignee: Hilfiker Pipe Company, Eureka, Calif.

[21] Appl. No.: 56,826

[22] Filed: Jul. 12, 1979

[51] Int. Cl.[3] ..... E02D 5/20; E02D 29/02

[52] U.S. Cl. ..... 405/262; 405/287

[58] Field of Search ..... 405/262, 272, 284, 286, 405/287; 249/10, 19

[56] References Cited

U.S. PATENT DOCUMENTS

| | | | |
|---|---|---|---|
| 1,693,311 | 11/1928 | Miller et al. | 405/287 X |
| 1,812,364 | 6/1931 | Oursler | 405/287 |
| 2,193,425 | 3/1940 | Lake | 405/272 X |
| 2,405,289 | 8/1946 | Cardwell | 405/262 |
| 3,152,198 | 10/1964 | Williams | 249/10 X |
| 3,981,038 | 9/1976 | Vidal | 405/284 X |

FOREIGN PATENT DOCUMENTS

| | | | |
|---|---|---|---|
| 610966 | 5/1979 | Switzerland | 405/286 |

*Primary Examiner*—David H. Corbin

*Attorney, Agent, or Firm*—Naylor, Neal & Uilkema

[57] ABSTRACT

A retaining structure for an earthen formation wherein spaced anchor members in the form of rock anchors or gridwork mats are embedded in the formation and wire retainers are secured between the anchor members. The retainers comprise primary retention rods secured to the anchors and secondary retention members secured to the rods to span the space between adjacent anchor members. In certain embodiments the anchors are provided with extensions to support form panels in spaced relationship to the secondary retention members and a concrete wall is formed in place between said panels and the secondary retention members.

20 Claims, 17 Drawing Figures

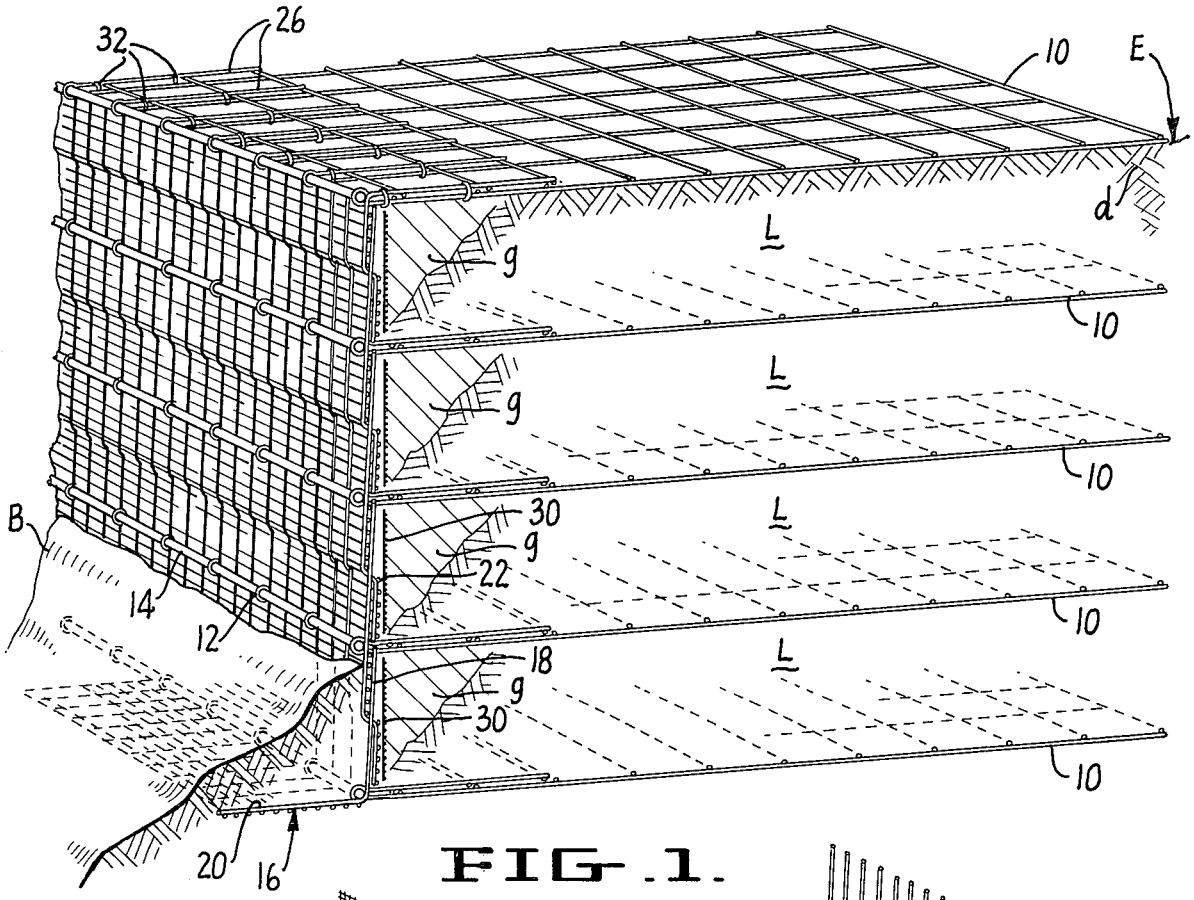
FIG. 1.
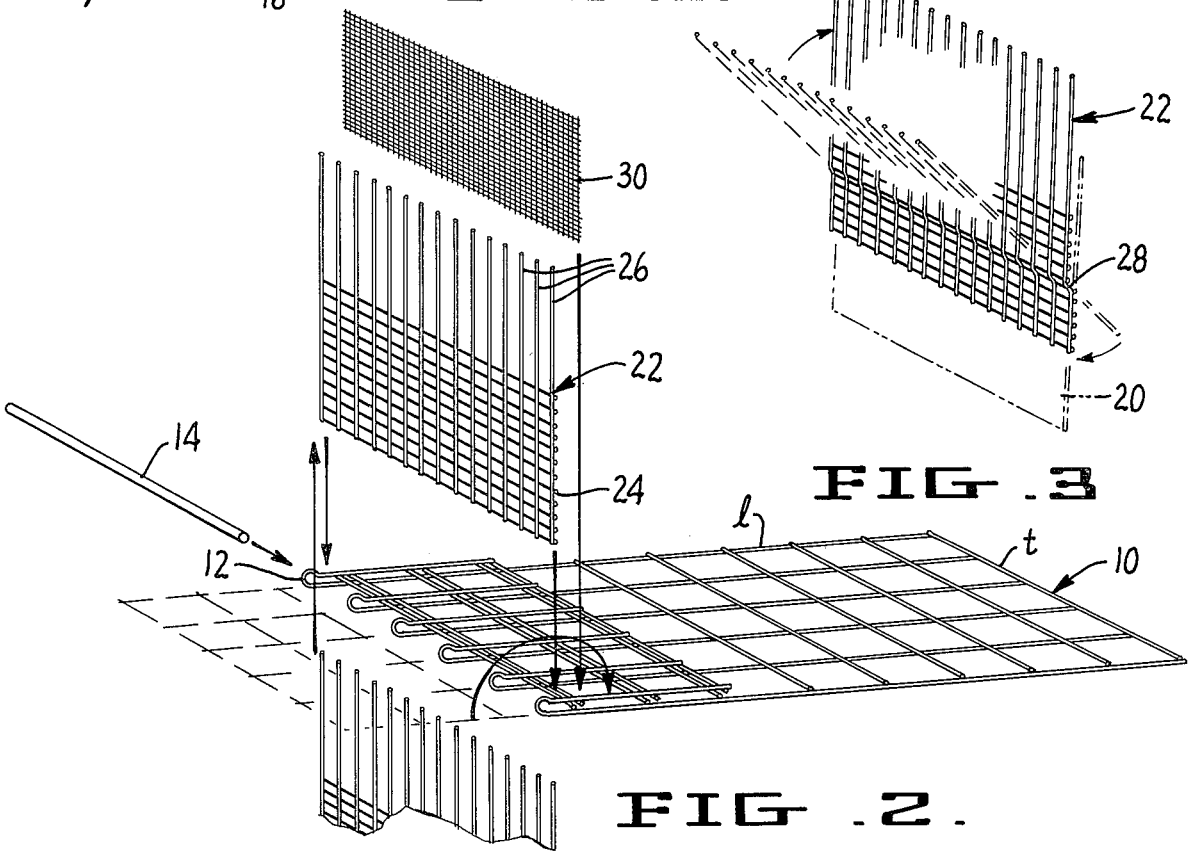
FIG. 3
FIG. 2.

METHOD AND APPARATUS FOR RETAINING EARTHEN FORMATIONS THROUGH MEANS OF WIRE STRUCTURES

BACKGROUND OF THE INVENTION

The present invention relates to wire retaining walls for earthen formations and, more particularly, is directed to such a wall which employs wire anchoring members and may be provided with a concrete face which is formed in place and forms an integral part of the wall.

One way of providing inexpensive retaining walls has been through the use of "gabions". Gabions are basket-like structures which can be filled with rock to provide permeable retaining walls. Early gabions were woven from plant fiber and not very durable. More recent gabions are fabricated of wire mesh.

Other recent efforts at providing wire retaining walls are exemplified by U.S. Pat. No. 4,117,686 to William K. Hilfiker, one of he coinventors herein, and French Pat. No. 7,507,114 to Henry Vidal. These patents employ tray-like elements fabricated of a wire gridwork wherein one side of the tray-like element serves as the anchoring member and the other side serves as the face member. As compared to gabions, the structures of these patents are of a simplified construction in that the wire members are of relatively simple open configuration and do not need to form a basket capable of fully enclosing a rock filler. Another advantage of the structures of these patents, as compared to gabions, is that the anchoring members provided by the tray-like elements serve to secure the retaining walls against displacement, in much the same way that "dead men" have been used to secure retaining walls. The anchoring member also reinforces the soil used for the back fill providing a composite reinforced soil system.

SUMMARY OF THE INVENTION

The wire retaining wall of the present invention is similar to that of aforementioned U.S. Pat. No. 4,117,687 and French Pat. No. 7,507,114 in that it employs anchor members, which may take the form of wire grids, which are embedded in the earthen formation to be reinforced. The invention is an improvement over that of said patents, however, in that the face member of the wall is not formed as part of a tray integral with the anchor members. As a result, the face member may have physical characteristics materially different from that of the anchor member (e.g., the face member may be of a fine mesh gridwork while the anchor member may be of a coarse mesh gridwork, or a simple rock anchor). The structure of the present invention also has the advantage that the face member may be erected separately from the anchor member, with the result that the size of the components being handled may be reduced and the face member components may take various forms and be retained in place through a variety of different retention structures.

The retaining wall of the present invention comprises a plurality of subassemblies, each of which includes an anchor member for embedment in the earthen formation to be reinforced, a primary retention rod secured to the anchor member for extension across the face of the earthen formation, a plurality of secondary retention rods releasably engaged with the primary rod so as to extend across the face of the earthen formation, and the mat juxtaposed to the secondary retention rods to confine the earthen formation. A fully assembled wall comprises a plurality of such subassemblies superimposed one above the other in the earthen formation to be reinforced. The secondary retention rods span the space between the primary retention rods of adjacent superimposed anchor members and, thus, serve as means to secure the mats to the anchor members to either side thereof.

A principal object of the present invention is to provide a retaining wall for earthen formations wherein the anchoring and face elements of the wall comprise separate wire members which are assembled into a composite structure at the situs of the wall.

Another object of the invention is to provide such a wall wherein the face element comprises a wire grid structure of a configuration ideally suited for retaining the earthen formation against sloughing and the anchoring elements are of a configuration ideally suited to anchor the wall and reinforce the earthen formation.

Still another object of the invention is to provide such a wall wherein the wire members may be shipped to the work situs in a flat condition.

Another object of the invention is to provide such a wall with means for forming a concrete face on the wall and securely fastening said face to the wall.

The foregoing and other objects will become more apparent when viewed in light of the following detailed description and accompanying drawings.

BRIEF DESCRIPTION OF THE DRAWINGS

FIG. 1 is a perspective view of an earthen formation reinforced by a retaining wall constructed according to a first embodiment of the invention wherein the wall is not provided with a concrete face;

FIG. 2 is an exploded perspective view of one set of the wire members used to construct the first embodiment retaining wall;

FIG. 3 is a perspective view of the face retention member of the first embodiment wall, illustrating the manner in which the member is swung into place as the wall is assembled.

DESCRIPTION OF THE FIRST EMBODIMENT

Figure 4:
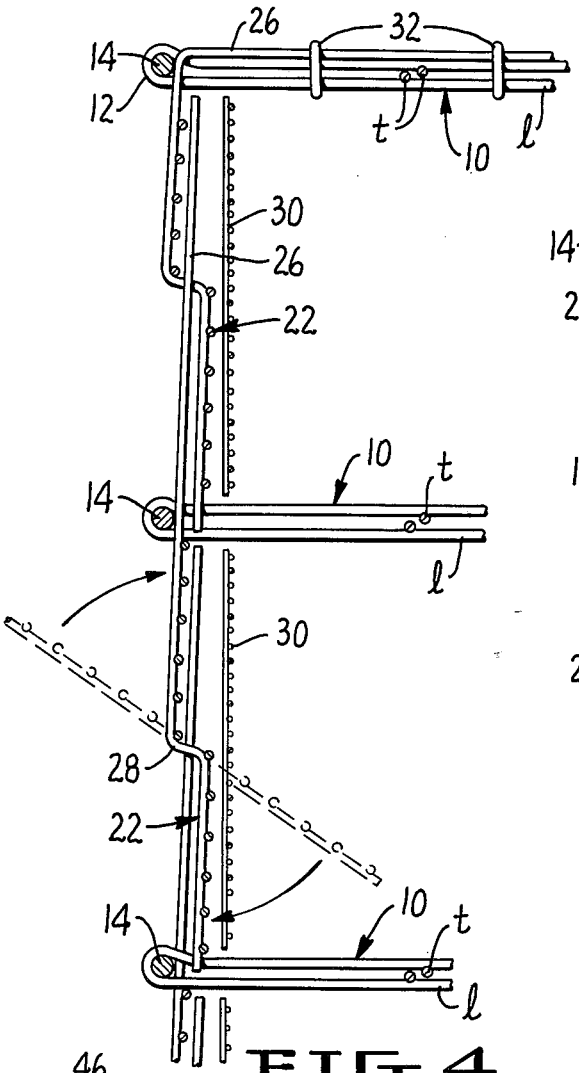
FIG. 4 is an elevational view, partially in section, illustrating the assembled wire members of the first embodiment wall and the manner in which the face retention member is swung into place.

Referring now to FIG. 1, the earthen formation to be reinforced is designated therein by the letter "E" and is shown as being divided into horizontal layers "L", each of which layers is comprised of back-fill soil "d" and a gravel face section "g". The layers "L" typically have a height of from two to three feet, and have interposed therebetween anchor members 10. In the embodiment of FIGS. 1 to 4, the anchor members 10 comprise a grid work of welded wires wherein the transversely extending wires "t" are spaced from one another by from six to 12 inches and the longitudinally extending wires "l" are spaced from one another by from two to six inches and welded to the wires "t" at the intersections therewith.

The anchor members 10 are folded over at the distal ends 12 thereof (see FIG. 2) and, when in place within a formation, these distal ends are positioned to be coincident with the face of the earthen formation where the wall is to be located. In the preferred embodiment, the folded over section of the distal ends of the anchor members 10 is preformed prior to placement of the mat in the earthen formation, and the ends are looped over a primary retention rod 14.

In erecting a wall according to the embodiment of FIGS. 1 to 4, a secondary retention member 16 is first layed in a generally horizontal position at the foot of the area to be reinforced. The lowermost anchor member 10 is then positioned over the bent up portion of secondary retention member 16 so that the primary retention rod 14 on the member 10 extends in front of secondary retention members 18 forming the bent up portion of the member 16. As can be seen from FIG. 1, the lowermost retention member 16 is of an L-shaped cross-section and comprises a grid work section 20 made up of welded wires and a finger section made up of the secondary retention rods 18. The retention rods 18 actually form extensions of the longitudinal elements of the grid work section 20. In the preferred embodiment, the rods 18 are spaced from one another by approximately four inches and the transversely extending members of the grid work section welded thereto are spaced from one another by approximately two inches.

Once the anchor members 10 and lowermost secondary retention member 16 are positioned in overlapping engagement as seen in FIG. 1, secondary retention member 22 is next slid over the rods 20 at an acute angle relative thereto (see the phantom line illustration in FIG. 3) and then swung in a clockwise direction to a position wherein it is disposed parallel to the rods 18. The member 22 is of the same general construction as the member 16, with the exception that the grid work section 24 and the finger section comprised of secondary retention rods 26 are disposed in coplanar relationship to one another, rather than disposed in generally right-angled relationship, as they are in the member 16. Thus, the grid work section 22 is comprised of intersecting welded rods wherein the transverse rods are spaced from one another by approximately two inches and longitudinally extending rods are spaced from one another by approximately four inches. The extending ends of the longitudinally extending rods of the grid work section 24 comprise the secondary retention rods 26 of the finger section.

As the member 22 is swung clockwise to the horizontal disposition (see FIG. 3), a kink 28 is formed in the grid work section 24. The kink results from forcing the lower portion of the section 24 against the inner side of the rods 18 and the upper portion of the section 24 against the outer sides of the rods 18. In the preferred arrangement, the lower and upper portions of the section 24 are disposed in parallel relationship to the rods 18. When swung fully into place, the member 22 assumes a generally vertical disposition with the secondary retention rods 26 extending upwardly. A mat or screen 30 is then positioned to the inside of the member 22 and then soil is back-filled and compacted into the lowermost layer "L" above the anchor member 10. The mat 30 is of a relatively fine mesh screen, such as a $\frac{1}{4}$ inch by $\frac{1}{4}$ inch grid, so that the gravel "g" will not pass therethrough. Hog rings may be used to secure the mat 30 in place.

After the lower layer and the anchor and retention elements therefor are assembled in the aforedescribed manner, the anchoring and retention elements and the back-fill of the layers thereabove are successively placed in essentially the same manner, with the exception that for the successive upper layers no angle-shaped secondary retention member, such as the member 16, is employed. Thus, for the layer immediately above the lowermost layer, a mat 10 is placed upon the back-fill of the lowermost layer with the distal end of the mat intersecting and extending slightly past the secondary retention rods 26 of the retention member 22 of the lowermost layer "L". After positioning of each successive mat 10, gravel "g" is filled into the space therebeneath. For the lowermost layer, at about the same time the gravel "g" is placed, back-fill "B" may be filled against the forward side of the member 22.

After positioning of the second level mat 10, a secondary retention member 22 is slid over the retention rods 18 extending upwardly from the mat and then swung into place, as shown in FIG. 3. A mat 30 is then placed behind said secondary retention member.

The foregoing process is repeated for the desired depth of the retaining wall (four layers as shown in the example of FIG. 1). At the completion of the uppermost layer, an anchor member 10 is positioned above the layer and the retention rods 26 from the secondary retention member therebelow are bent over the anchor member and secured thereto by hog rings 32. After the uppermost anchor member is so placed, a layer of back-fill may be placed partially thereover, limited in such a manner that it will not spill over the front side of the retaining wall.

DESCRIPTION OF THE SECOND EMBODIMENT

Figure 5:
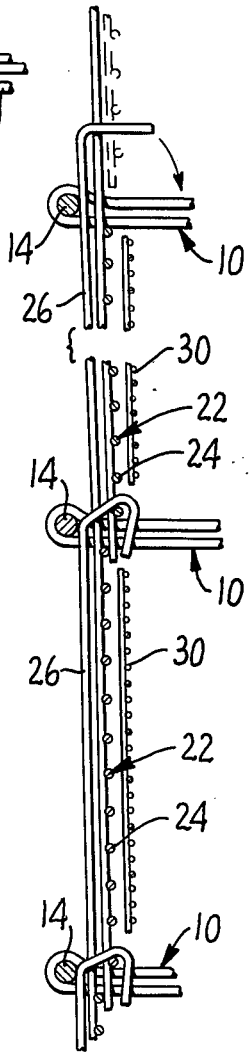
FIG. 5 is an elevational view, partially in section, illustrating the assembled wire members of a second embodiment wall and the manner in which the face retention member of the wall is secured into place.

The embodiment of FIG. 5 differs from that of FIGS. 1 to 4 only in the way in which the secondary retention members 22 are placed. Accordingly, the elements of the FIG. 5 embodiment are designated by the same numerals used by the FIGS. 1 to 4 embodiment.

In the FIG. 5 embodiment, the successive secondary retention members 22 are placed behind the secondary retention rods 26 of each preceding secondary retention member. Thus, there is no swinging or kinking of the secondary retention members, as depicted in FIG. 3 of the first embodiment. After each secondary retention member of the FIG. 5 embodiment is placed, the upper ends of the secondary retention rods extending in front of said member are bent back at a right angle, as depicted at the top of FIG. 5. Thereafter, the next successive secondary retention member is placed and, then, the bent-over ends are bent around the lowermost transverse rod of said secondary retention member and down, as depicted at the bottom and center portion of FIG. 5. With the secondary retention rod so bent over, each secondary retention member is held in place.

DESCRIPTION OF THE THIRD EMBODIMENT

Figure 7:
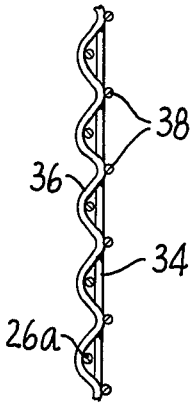
FIG. 7 is a cross-sectional view of the third embodiment wall, taken on the plane designated by line 7—7 of FIG. 6.
Figure 6:
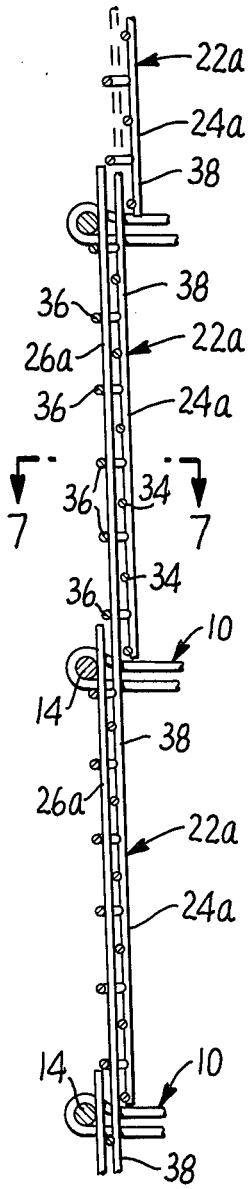
FIG. 6 is an elevational view, partially in section, illustrating the assembled wire members of a third embodiment wall and the manner in which the face retention member of that embodiment is secured in place.

The embodiment of FIGS. 6 and 7 differs from that of FIGS. 1 to 4 only in the construction and method of placement of the secondary retention members. In the FIGS. 6 and 7 embodiment, the retention member is designated by the numeral **22*a* and is shown as comprising a grid work section 24*a* and a finger section made up of secondary retention rods 26*a* formed of extensions of he longitudinal elements of the grid work section. The transverse grid elements of the grid work section 24*a* comprise alternating straight elements 34 and sinusoidal shaped elements 36 welded at the intersections thereof to the longitudinal extending elements of the grid work section. The numeral 38 is used to depict the longitudinally extending elements of the grid work sections to which the elements 36 and 34 are welded. As viewed in FIGS. 6 and 7, the elements 38 are to the right-hand side. The extensions of these elements form the rods 26*a*. In the preferred embodiment, the space between the rods 34 and 36 is approximately two inches and the space between the rods 38** is approximately four inches.

Viewed in plane, as seen in FIG. 7, the space between the rods 34 and 36 defines continuous vertical passages through the grid work section **22*a*. These passages are proportioned for slidable receipt of the secondary retention rods 26*a*. In assembly of the wall, each successive secondary retention member 22*a* is slid over the secondary retention rods 26*a* of the secondary retention member therebelow. The latter operation may be seen from the phantom line illustration at the top of FIG. 6**.

The threading of each secondary retention member over the secondary retention rods of the member therebeneath functions to divide the longitudinal space between the elements 38 in one-half. Thus, the grid work provided by the grid work sections of the secondary retention members **22*a* is reduced to a two-inch by two-inch pattern. Where the gravel used as back-fill is sufficiently large, this relatively small grid work pattern avoids the necessity of using mats, such as the mats 30**.

DESCRIPTION OF THE FOURTH EMBODIMENT

Figure 8:
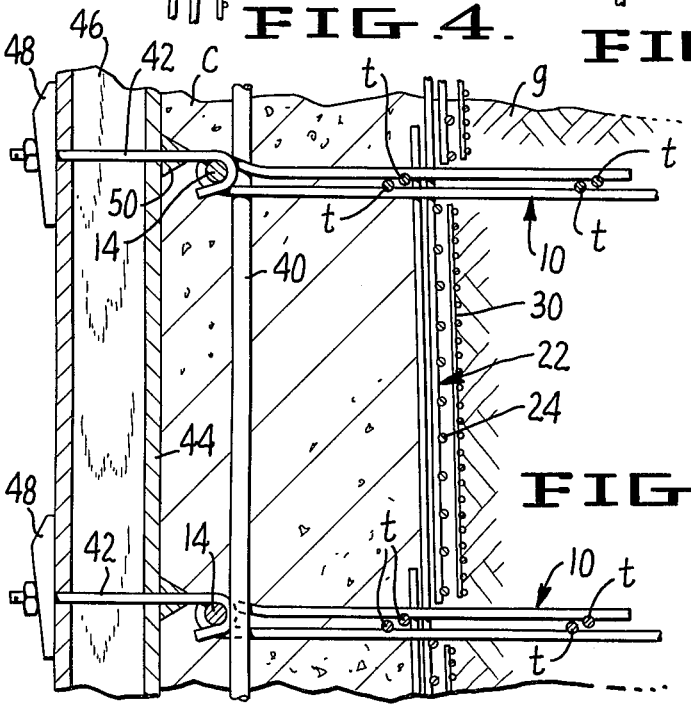
FIG. 8 is a cross-sectional elevational view of an earthen formation reinforced by a retainer wall constructed according to a fourth embodiment of the invention wherein a concrete face is formed on the wall and the wire members of the wall are shown supporting a form panel and reinforcing bar for the wall.

The FIG. 8 embodiment corresponds to that of FIG. 5, with the following exceptions: (1) the ends of the secondary retention rods are not bent over; (2) secondary retention members are extended behind the transverse grid elements of the primary retention members in inwardly spaced relationship relative to the distal ends of the primary retention members; and (3) a concrete face is formed to the external side of the wire retaining wall and secured thereto through means of the primary retention rods 14 and reinforcement elements cooperating therewith. The elements of the FIG. 8 embodiment corresponding to those of the embodiments of FIG. 5 and FIGS. 1 to 4 are designated by like numerals.

The wire elements of the retention wall of FIG. 8 are assembled in essentially the same manner as those of FIG. 5, with the exception that the secondary retention rods 26 are not bent over and the secondary retention rods are extended behind the transversely extending wires "t" next adjacent the primary rods 14 rather than immediately behind said rods. Once the wire elements are so assembled, reinforcing rods are extended vertically behind the rods 14 and snap-ties 42 are hooked over the rods 14 and used to secured form panels 44 in place. Walers 46 extend over the outside of the panels 44 and wedges 48 are engaged with the snap-ties 42 and the walers.

After the wire elements of the wall are erected and form panels are secured into place, a concrete wall "C" is formed in the space between the secondary retention members 22 and the form panel 44. Once this wall is sufficiently cured, the snap-ties 42 are broken and the form panels are removed. Grouting cores 50 are removed with the panels and leave conical openings in the face of the wall which may, if desired, be grouted over.

DESCRIPTION OF THE FIFTH EMBODIMENT

Figure 9:
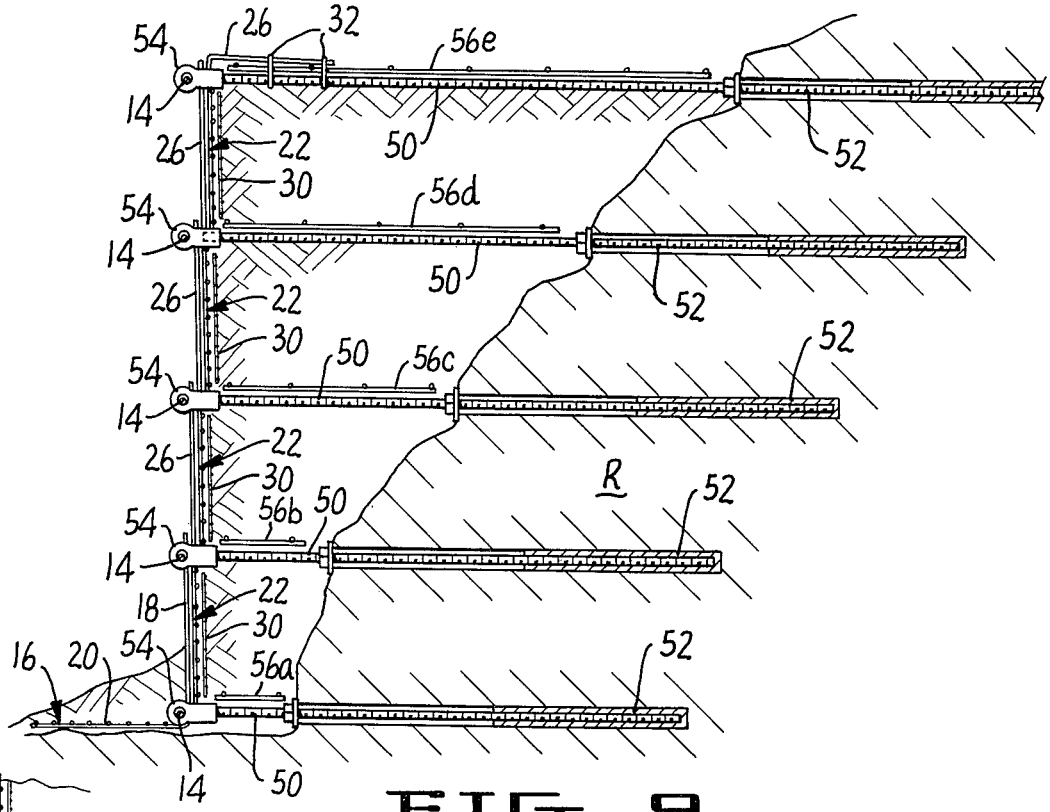
FIG. 9 is an elevational view of an earthen formation reinforced by a retainer wall constructed according to a fifth embodiment of the invention wherein the anchor members of the wall comprise rods secured in place through means of rock anchors.

The embodiment of FIG. 9 is designed for use in retaining an earthen formation backed by a rock strata "R". This embodiment differs from that of the previous embodiments primarily in that the anchor members comprise bolts 50 having rock anchors 52 engaged with the strata "R". The distal ends of the bolts 50 have fittings 54 engaged therewith, which fittings are formed with transversely extending passages for receipt of primary retention rods 14. The primary retention rods, secondary retention members, and mats of the FIG. 9 embodiment correspond to those of the embodiments of FIGS. 1 to 4 and FIG. 5 and, accordingly, are designated by like numerals.

In assembling the wall of FIG. 9, the lowermost rock anchor bolts 50 are first anchored in the strata "R" so that the fittings 54 on said bolts are positioned proximate the plane wherein it is desired to locate the retaining wall. The bolts are typically located on six to eight foot centers and disposed so as to be coplanar with one another. After so positioning the lowermost anchor bolts, the lowermost secondary retention members 16 are positioned so that the secondary retention rods 18 thereof extend upwardly from behind the primary retention rod receiving openings in the fittings 54. The rods 14 are then positioned in said openings, thus securing the members 16 in place. Thereafter, a grid work mat 56*a* is positioned over the lowermost anchor bolts and the next successive secondary retention member 22 is positioned behind the rods 18. A screen is then positioned behind the member 22 and this is followed by the placement of the next successive course of anchor rock bolts 50. The latter course of bolts is typically placed from two to three feet above the bolts therebelow. Once said successive course of bolts is in place, the primary retention rods 14 are extended through the fittings of said course of bolts in front of the rods 18. Then, back-fill material is filled into the space between the rock strata "R" and the mat 30 disposed behind the rods 18. As shown in FIG. 9, back-fill may also be placed in front of the wall to cover the grid work section 20 of the member 16.

The grid work mat 56*a* is provided for purposes of reinforcing the back-fill between the strata "R" and the mat 30. In the preferred embodiment mat 56*a* may be omitted if the face of wall is sufficiently close to strata "R" as to make it unnecessary. If the mat 56*a* is used, the grid work of the mat comprises intersecting rods which are welded together and spaced from one another by from two to 12 inches.

After the first and second courses of anchor bolts are in place and the secondary retention members have been assembled as described in the foregoing discussion, the next anchor bolts and retention members are successively placed and assembled in the same manner until the wall reaches the desired composite. In the illustrated embodiment of FIG. 9, with each successive course of anchor members, the distance between the fittings 54 on the members and the strata "R" increases. Thus, the length of the mats positioned above the successive courses of anchor members also increases. The mats are fabricated of a grid work corresponding to that of the mat 56*a* and are designated by the numerals 56*b*, 56*c*, 56*d* and 56*e*, respectively. The mat 56*e* is the uppermost mat and is secured in place by bending the uppermost retention rods 26 over the mat and then securing said members to the mat and the uppermost rock bolt 50 by hog rings 32. Additional back-fill may also be placed above the mat 56*e*, but such fill should be limited so that it will not slough off over the front of the wall. It is also possible to continue the wall upwardly from the topmost mat 56*e*, using mat anchors of the type employed in the previous embodiments.

DESCRIPTION OF THE SIXTH EMBODIMENT

Figure 11:
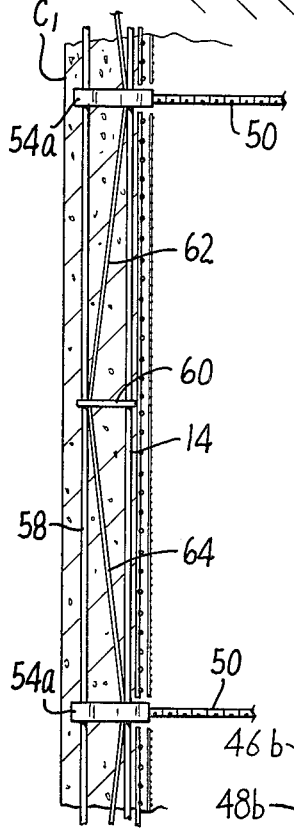
FIG. 11 is a cross-sectional view taken on the plane designated by line 11—11 of FIG. 10.
Figure 10:
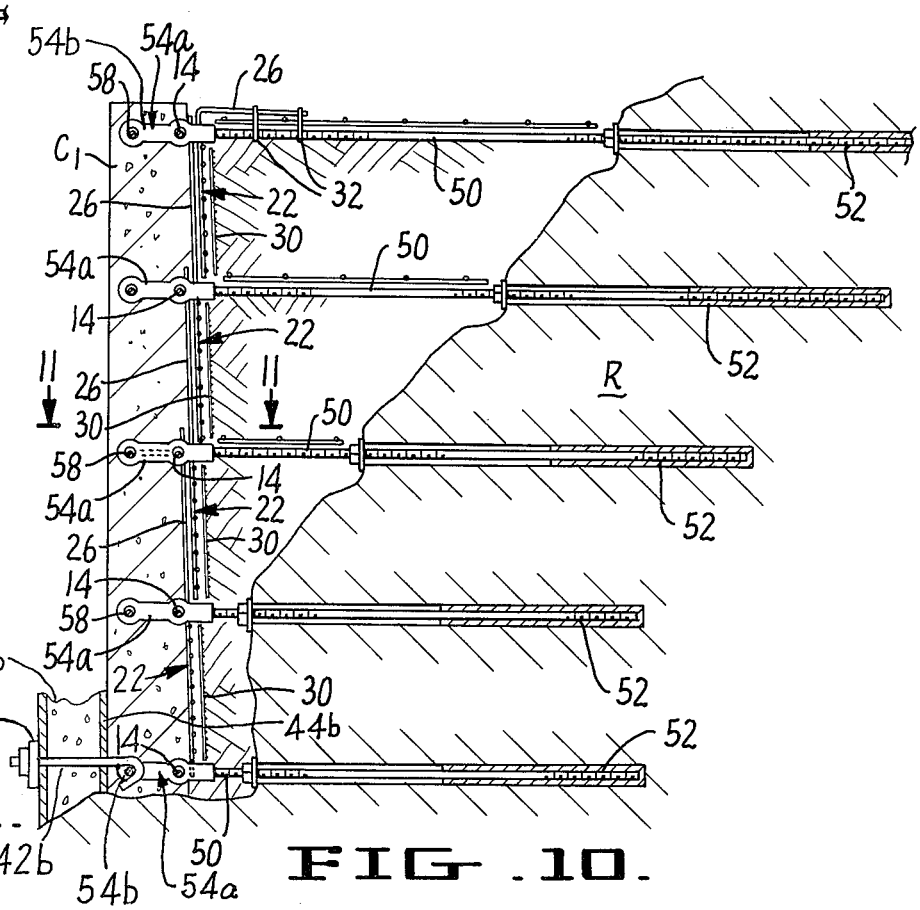
FIG. 10 is an elevational view of an earthen formation reinforced by a retaining wall constructed according to a sixth embodiment of the invention, which embodiment differs from that of the fifth embodiment, primarily in that it includes a concrete face formed on the wall.

The embodiment of FIGS. 10 and 11 differs from that of FIG. 9 only in that: (1) the fittings, designated 54*a*, are provided with extensions; 546 (2) reinforcing rods 58 are carried by the fittings; (3) the lowermost secondary retaining member 16 is omitted; and (4) a concrete wall "$C_1$" is formed in place against the outer wire elements of the wall. The wire retaining elements and back-fill of the FIGS. 10 and 11 embodiment are assembled and placed in a manner corresponding to that of the FIG. 9 embodiment, except that: (1) the element 16 may be omitted and the lowermost member 22 is simply held in place behind the lowermost primary retention rods 14; and, (2) the first two successive courses of anchor bolts are not covered with mats, such as the mats 56*a* and 56*b*. The member 16 and the mats 56*a* and 56*b* have been omitted because, in the embodiment illustrated, the lowermost courses of anchor bolts are very short.

The rods 58 are extended through the extensions of the fittings 54*a* and braced by a truss structure, as may be seen from FIG. 11. This structure comprises a central support 60 interposed between the rods 58 and 14 centrally of the space between adjacent bolts 50 and tie elements 62 connected between the outer end of the support 60 and the fittings 54*a* to either side thereof. With the truss structure so placed to help support secondary retention member 22, concrete is cast therearound to form the wall "$C_1$". For the latter purpose, a form panel 44*b* similar to that shown in FIG. 8 may be temporarily secured to the rods 58 through means of snap-ties 42*b*, walers 46*b* and wedges 48*b* similar to those shown in FIG. 8. After the wall is fully formed and set, the snap-ties are broken and the form removed.

DESCRIPTION OF THE SEVENTH EMBODIMENT

Figure 12:
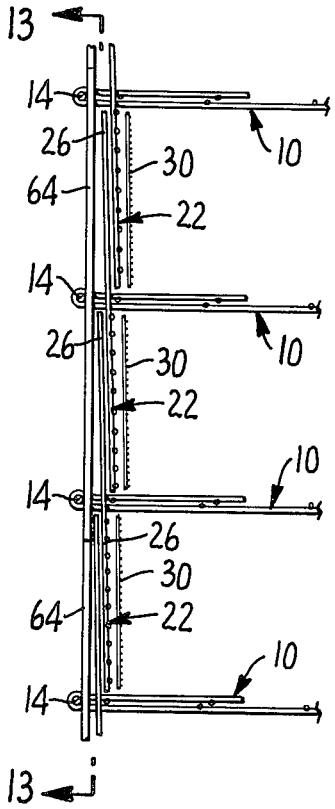
FIG. 12 is a cross-sectional elevational view illustrating the assembled wire members of a seventh embodiment wall wherein face rods are interposed between the primary retention rods and the secondary retention members.
Figure 13:
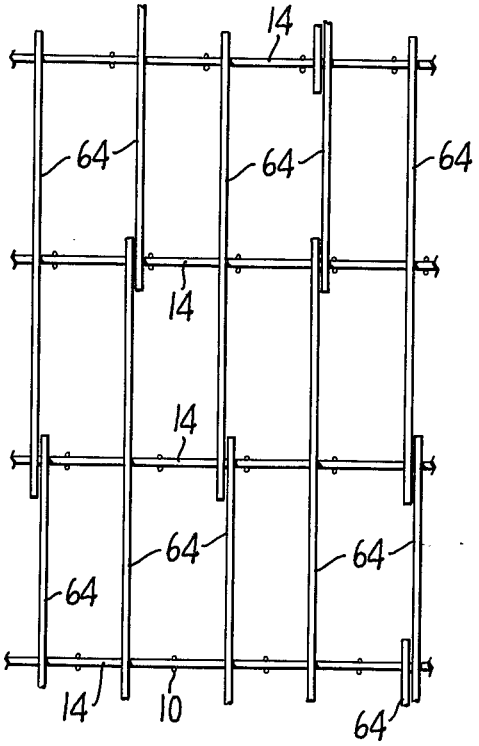
FIG. 13 is a cross-sectional view of the seventh embodiment wall taken on the plane designated by line 13—13 of FIG. 12.

The embodiment of FIGS. 12 and 13 corresponds to that of FIG. 5, with the following exceptions: (1) the upper ends of the secondary retention rods 26 are not bent over; and (2) face rods 64 are disposed in spanning relationship to the primary retention rods 14 between said rods and the secondary retention members 22. The manner in which the face rods are placed can be seen from FIG. 13. The rods are located at approximately two-foot centers and, in the preferred embodiment, are held in place by friction.

The purpose of the face rods 64 is to lend additional support to the face of the retaining wall. The technique for assembling the wall corresponds identically to that described with respect to FIG. 5, with the addition that the retention rods 64 are successively placed in advance and in front of the secondary retention members 22.

DESCRIPTION OF THE EIGHTH EMBODIMENT

Figure 14:
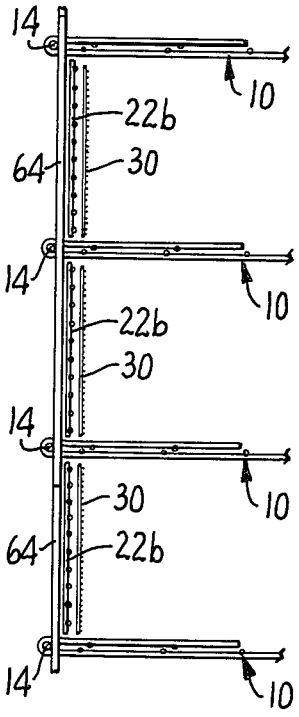
FIG. 14 is a cross-sectional elevational view illustrating the assembled wire members of an eighth embodiment wall wherein face rods similar to those of the seventh embodiment are employed.

The embodiment of FIG. 14 differs from that of FIGS. 12 and 13 only in that the secondary retention members, designated 22*b*, are not provided with secondary retention rods, such as the rods 26. As a result of this difference, the retention of the secondary members 22*b* is dependent upon the face rods 64. The technique used for assembling the wall of the FIG. 14 embodiment corresponds to that used for the wall of the FIGS. 12 and 13 embodiment.

DESCRIPTION OF THE NINTH EMBODIMENT

Figure 15:
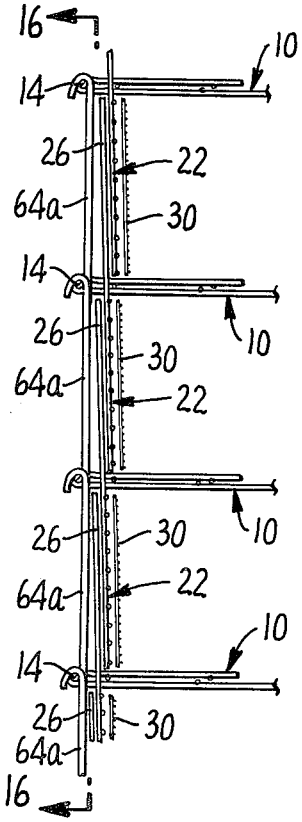
FIG. 15 is a cross-sectional elevational view illustrating the assembled wire members of a ninth embodiment wall, wherein face rods are hooked over the primary retention rods and interposed between said rods and the secondary retention members.
Figure 16:
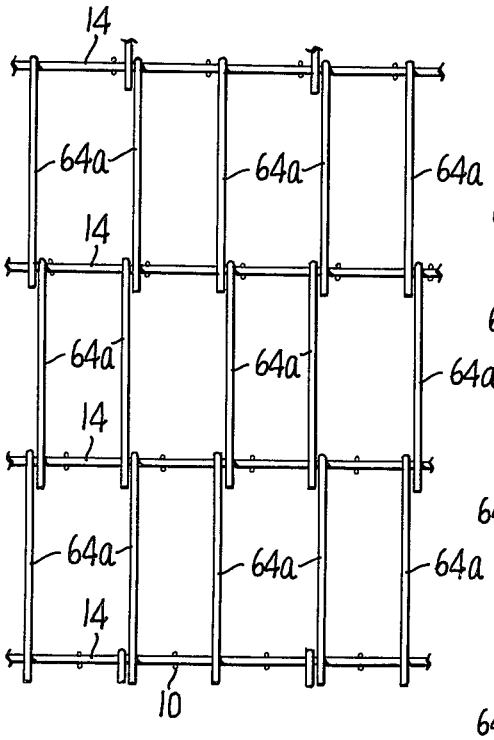
FIG. 16 is a cross-sectional elevational view of the ninth embodiment wall, taken on the plane designated by line 16—16 of FIG. 15.

The FIGS. 15 and 16 embodiment corresponds identically to that of FIGS. 12 and 13, with the exception that the face rods, designated 64*a*, are hooked over the primary retention rods. The technique for assembling the wall of the FIGS. 15 and 16 embodiment is essentially the same as that of the FIGS. 12 and 13 embodiment, with the exception that the installer must orientate the face rods 64*a* so that the hooked ends engage over the primary retention rods 14. The provision of the hook ends assures that the rods 64*a* will not slip down, even in the absence of pressure thereon.

DESCRIPTION OF THE TENTH EMBODIMENT

Figure 17:
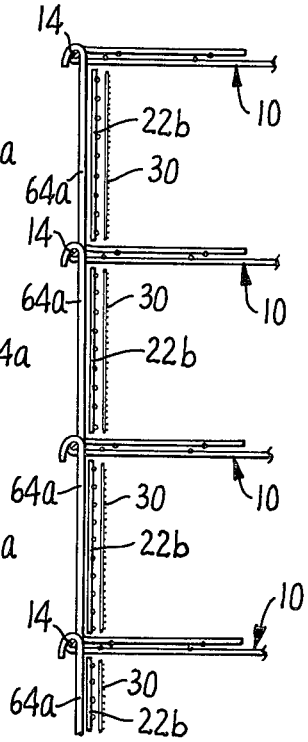
FIG. 17 is a cross-sectional elevational view illustrating the assembled wire members of a tenth embodiment wall, wherein face rods similar to those of the ninth embodiment wall are employed.

The embodiment of FIG. 17 is identical to that of FIGS. 15 and 16, with the exception that it employs secondary retention members 22*b* which do not include secondary retention rods 26. The retention members 22*b* of the FIG. 17 embodiment are identical to that of the like numbered members of the FIG. 14 embodiment and, like those of the FIG. 14 embodiment, rely upon the face rods for their retention.

The assembly technique used for the FIG. 17 embodiment corresponds identically to that used for the FIGS. 15 and 16 embodiment, with the exception that there is no need to place secondary retention rods, such as the rods 26.

CONCLUSION

From the foregoing detailed description, it is apparent that the present invention enables the attainment of the objects initially set forth herein. It should be understood, however, that the invention is not intended to be limited to the specifics of the illustrated embodiments. For example, it is anticipated that with certain types of sub-strata, a wall might be fabricated wherein certain anchor courses employ anchor mats, such as the mats 10, and others employ rock anchors, such as those used with the bolts 50.

What is claimed is:

1. A retaining wall structure comprising, in combination: an anchor member for embedment in an earthen formation to be reinforced; a retention structure secured to said anchor member for extension across the face of an earthen formation to be reinforced; an extension secured relative to said anchor member and disposed outwardly of the retention structure for embedment in a concrete wall cast in place externally of the surface of an earthen formation to be reinforced; and concrete form panel retention means carried by said extension for securing a form panel in spaced relationship to the earthen formation to be reinforced.

2. A retaining wall structure according to claim 1, further comprising: a mat engaged with the retention structure to confine the earthen formation to be reinforced.

3. A retaining wall structure according to claim 1, wherein said extension includes means to secure a concrete reinforcing rod to the anchor member in spaced relationship to the earthen formation to be reinforced.

4. A retaining wall structure according to claim 1 wherein the anchor member comprises a mat fabricated of fixedly interconnected intersecting wire elements.

5. A retaining wall structure according to claim 1 wherein the anchor member comprises a rod having a rock anchor secured to one end thereof.

6. A retaining wall structure comprising, in combination: at least three anchor members disposed in vertically spaced relationship to one another; a retention structure for each of said anchor members, said respective structures being secured to the anchor members therefor so as to extend in spaced generally parallel relationship to one another; extensions secured relative to at least certain of said members and disposed outwardly of the primary retention structures therefor for embedment in a concrete wall cast in place externally of the surface of an earthen formation to be reinforced; and concrete form panel retention means carried by at least certain of said extensions for securing a form panel in spaced relationship to the earthen formation to be reinforced.

7. A retaining wall structure according to claim 6, further comprising mats engaged with the respective retention structures to confine the earthen formation to be reinforced.

8. A retaining wall structure according to claim 6, wherein said extensions include means for securing a concrete reinforcing rod to the anchor member in spaced relationship to the earthen formation to be reinforced.

9. A retaining wall structure according to claim 6 wherein: the respective retention structures each comprise a primary retention rod secured to the anchor member therefor for extension across the face of an earthen formation to be reinforced; and a plurality of secondary retention rods engaged with said primary rod so as to extend across the face of an earthen formation to be reinforced in a direction generally normal to the primary retention rod.

10. A retaining wall structure according to claim 6 wherein at least certain of the anchor members comprise a mat fabricated of fixedly interconnected intersecting wire elements.

11. A retaining wall structure according to claim 6 wherein at least certain of the anchor members comprise a rod having a rock anchor secured to one end thereof.

12. A retaining wall structure according to claim 9 wherein said secondary retention rods extend between the primary retention rods and an earthen formation to be reinforced.

13. A retaining wall according to claim 1 wherein the retention structure comprises a primary retention rod secured to the anchor member for extension across the face of an earthen formation to be reinforced; and a plurality of secondary retention rods releasably engaged with said primary rods so as to extend across the face of an earthen formation to be reinforced in a direction generally normal to the primary retention rod.

14. A method of constructing a retaining wall for an earthen formation, said method comprising: embedding a plurality of anchor members in the formation in vertically spaced relationship to one another so that the distal ends thereof are located proximate the face wherein it is desired to locate the wall; providing a retention structure for each of the anchor members, said structures being secured to the anchor members in generally parallel relationship to one another and in a plane generally coincident with the face wherein it is desired to locate the wall; securing extensions relative to at least certain of the anchor members, said extensions protruding outwardly relative to the retention structures; securing form panels to the extensions in spaced relationship to the retention structures; forming a concrete wall against said form panels in the space between said panels and the retention structures; and back-filling the space between the earthen formation to be reinforced and the retention structures.

15. A method according to claim 14, further comprising positioning mats in juxtaposition to the sides of the retention structures facing the earthen formation to be reinforced.

16. A method according to claim 14, further comprising securing concrete reinforcing rods to said extensions in the space between the form panels and the retention structures, said reinforcing rods being secured in place prior to the formation of concrete in said space.

17. A method according to claim 14 wherein the anchor members comprise rods having rock anchors at one end thereof and the rods are embedded by securing the rock anchors to a rock formation and then back-filling in front of the formation.

18. A method according to claim 17, further including placing gridwork mats over the rods in advance of back-filling.

19. A method according to claim 14 wherein the anchor members comprise gridwork mats placed in advance of back-filling.

20. A method according to claim 14 wherein the retention structures comprise primary retention rods secured to the anchor members therefor in spaced generally parallel relationship to one another for extension across the earthen formation and gridwork sections positioned to span the space between each adjacent pair of primary retention rods.

* * * * *